US010488121B2

(12) United States Patent
Matsunaga et al.

(10) Patent No.: US 10,488,121 B2
(45) Date of Patent: Nov. 26, 2019

(54) HEAT EXCHANGER

(71) Applicant: KOBELCO CONSTRUCTION MACHINERY CO., LTD., Hiroshima-shi (JP)

(72) Inventors: Hidenori Matsunaga, Hiroshima (JP); Tomotaka Kita, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 15/763,707

(22) PCT Filed: Sep. 23, 2016

(86) PCT No.: PCT/JP2016/078001
§ 371 (c)(1),
(2) Date: Mar. 27, 2018

(87) PCT Pub. No.: WO2017/057184
PCT Pub. Date: Apr. 6, 2017

(65) Prior Publication Data

US 2018/0283805 A1 Oct. 4, 2018

(30) Foreign Application Priority Data

Sep. 30, 2015 (JP) ..... 2015-193508

(51) Int. Cl.
*F28F 9/00* (2006.01)
*F28F 9/02* (2006.01)
(Continued)

(52) U.S. Cl.
CPC ..... *F28F 9/0229* (2013.01); *F28D 1/05383* (2013.01); *F28F 9/028* (2013.01);
(Continued)

(58) Field of Classification Search
CPC ..... F28F 9/005; F28F 9/185; F28F 9/0219; F28F 2265/00; F28F 2265/16
(Continued)

(56) References Cited

U.S. PATENT DOCUMENTS 4,465,129 A 8/1984 Baldensperger et al.
8,656,988 B1 * 2/2014 Paul ..... F28D 1/05366 165/151
(Continued)

FOREIGN PATENT DOCUMENTS

CN 205037793 U 2/2016
DE 2009122 A1 * 9/1970 ..... F28F 9/162
(Continued)

OTHER PUBLICATIONS

International Search Report dated Oct. 25, 2016 in PCT/JP2016/078001 filed Sep. 23, 2016.
(Continued)

*Primary Examiner* — Allen J Flanigan
(74) *Attorney, Agent, or Firm* — Oblon, McClelland, Maier & Neustadt, L.L.P.

(57) ABSTRACT

It is intended to suppress occurrence of a crack in a fixed portion of a tube with respect to a tank. A plurality of tubes (4A to 4D) are fixed to a sidewall (9) in a state in which they penetrate through the sidewall (9) via respective ones of a plurality of through-holes (9*b*) formed in the sidewall (9) in such a manner as to be arrayed in a line along a longitudinal direction. A heat exchanger (1) comprises a protective member (5) fixed to the sidewall (9) to protect a nearest tube (4A) nearest to an end wall (10) among the plurality of tubes (4A to 4D), wherein the protective member (5) has a barrier portion (13) interposed between the end wall (10) and an outlet-side end portion (4*b*) of the nearest tube (4A) disposed inside the sidewall (9).

7 Claims, 9 Drawing Sheets

(51) Int. Cl.
*F28D 1/053* (2006.01)
*F28D 21/00* (2006.01)

(52) U.S. Cl.
CPC ..... *F28F 9/0243* (2013.01); *F28F 9/0265* (2013.01); *F28D 2021/0082* (2013.01); *F28F 2225/04* (2013.01); *F28F 2225/08* (2013.01); *F28F 2265/02* (2013.01)

(58) Field of Classification Search
USPC ..... 165/174, 178, 906
See application file for complete search history.

(56) References Cited

U.S. PATENT DOCUMENTS

| | | | | |
|---|---|---|---|---|
| 2007/0144718 | A1* | 6/2007 | Heine | F28D 1/05366 165/173 |
| 2015/0129188 | A1* | 5/2015 | Frankiewicz | B23P 15/26 165/173 |

FOREIGN PATENT DOCUMENTS

| | | | | |
|---|---|---|---|---|
| DE | 24 49 070 | A1 | | 5/1975 |
| FR | 2 742 528 | A1 | | 6/1997 |
| FR | 2 742 533 | A1 | | 6/1997 |
| GB | 1 485 287 | A | | 9/1977 |
| JP | 59-103089 | U | | 7/1984 |
| JP | 2008-39271 | A | | 2/2008 |
| JP | 2008039271 | A | * | 2/2008 |
| JP | 2013-249971 | A | | 12/2013 |

OTHER PUBLICATIONS

Extended European Search Report dated Oct. 8, 2018 in European Patent Application No. 16851358.8, citing documents AA, and AO through AR therein, 6 pages.

* cited by examiner

HEAT EXCHANGER

TECHNICAL FIELD

The present invention relates to heat exchangers for cooling a target fluid, such as a radiator and an oil cooler.

BACKGROUND ART

There has heretofore been known a construction machine comprising an engine, a hydraulic pump configured to be driven by the engine, and a hydraulic actuator configured to be operated by hydraulic oil discharged from the hydraulic pump.

This type of construction machine is equipped with a radiator for cooling coolant water for cooling the engine (target fluid), and an oil cooler for cooling hydraulic oil led out of the hydraulic actuator (target fluid).

As a device usable as each of the radiator and the oil cooler, there has been known a heat exchanger described, for example, in the following Patent Literature 1.

FIG. 9 is a sectional view enlargedly depicting a part of the heat exchanger described in the Patent Literature 1.

The heat exchanger 101 described in the Patent Literature 1 comprises: an inlet-side tank 102 into which a target fluid to be cooled is led through a non-depicted inlet port thereof; an outlet-side tank 103 out of which the target fluid is led through a non-depicted outlet port thereof; and a plurality of tubes each fluidically connecting the inlet-side tank 102 to the outlet-side tank 103 (in FIG. 9, two 104A, 104B of the plurality of tubes are depicted).

The inlet-side tank 102 is a container extending along a given axis (an axis extending in a rightward-leftward direction in FIG. 9). Specifically, the inlet-side tank 102 has a sidewall 105 extending along the axis and surrounding the axis; and a pair of end walls 106 closing, respectively, two openings at opposite ends of the sidewall in a longitudinal direction of the inlet-side tank 102 along the axis (in FIG. 9, only one of the end walls 106 is depicted). The sidewall 105 is formed with a plurality of through-holes 105*a* which are arrayed in a line along the longitudinal direction (in FIG. 9, two of the plurality of through-holes 105*a* are depicted).

The outlet-side tank 103 has a configuration similar to that of the inlet-side tank 102. The two tanks 102, 103 are arranged such that respective axes thereof extend in parallel relation to each other, and respective sets of the plurality of through-holes 105*a* thereof are symmetrically opposed to each other.

The tube 104A penetrates through the sidewalls 105 of the two tanks 102, 103, via an opposed pair of the through-holes 105*a* of the two tanks 102, 103. Specifically, one end 104*a* of the tube 104A is disposed within the inlet-side tank 102, and the other end 104*a* of the tube 104A is disposed within the outlet-side tank 103. In this state, the tube 104A is fixed to the two tanks 102, 103 in such a manner that a portion thereof inserted in the pair of through-holes 105*a* is fixed to the sidewalls 105 of the two tanks 102, 103 by fixing means such as brazing. In the same manner, the tube 104B is fixed to the two tanks 102, 103.

The target fluid is led into the inlet-side tank 102 through the non-depicted inlet port, and after being led from the inlet-side tank 102 to the outlet-side tank 103 via the tubes 104A, 104B, lead out of the outlet-side tank 103 through the non-depicted outlet port. The target fluid is cooled by heat exchange with outside air in the course of passing through the tubes 104A, 104B.

However, in the heat exchanger 101, the tube 104A nearest to the end walls 106 of the two tanks 102, 103 is likely to crack in the portion thereof fixed to the two tanks 102, 103, thereby leading to leakage of the target fluid from the cracked area. The reason is considered as follows.

In the inlet-side tank 102, the target fluid led through the non-depicted inlet port is moved in the longitudinal direction, and finally led into the tubes 104A, 104B. However, in the course of the above movement, when the target fluid reaches the end wall 106 and becomes unable to go straight ahead any more, it is turned toward the end 104*a* of the tube 104A nearest to the end wall 106, as indicated by the arrowed line Y3. Due to the above flow, the end 104*a* of the tube 104A is applied with a force from the target fluid and thereby inclined about a base of the end 104*a* serving as a supporting point, as indicated by the arrowed line Y4, and, accordingly, a crack is formed in the fixed portion (particularly, a part of the fixed portion on the side of the end wall 106).

On the other hand, the target fluid led into the outlet-side tank 103 via the tubes 104A, 104B is moved in a longitudinal direction of the outlet-side tank 103, and finally led to the non-depicted outlet port. However, in the course of the above movement, when the target fluid reaches the end wall 106 and becomes unable to go straight ahead any more, it is turned toward the end 104*a* of the tube 104A nearest to the end wall 106, as indicated by the arrowed line Y5. Due to the above flow, the end 104*a* of the tube 104A is applied with a force from the target fluid and thereby inclined about a base of the end 104*a* serving as a supporting point, as indicated by the arrowed line Y6, and, accordingly, a crack is formed in the fixed portion.

Another reason for the formation of a crack in the fixed portion is considered that the ends 104*a* of the tube 104A receive forces from the flows of the target fluid indicated by the arrowed lines Y3, Y5, and, due to these forces, a peripheral wall of the tube 104A is concavely deformed.

CITATION LIST

Parent Literature

Parent Literature 1: JP 2008-39271A

SUMMARY OF INVENTION

It is an object of the present invention to provide a heat exchanger capable of suppressing occurrence of a crack in a fixed portion of a tube with respect to a tank.

In order to solve the aforementioned problem, the present invention provides a heat exchanger for cooling a target fluid. The heat exchanger comprises: an inlet-side tank having an inlet port for leading the target fluid into the inlet-side tank therethrough; an outlet-side tank having an outlet port for leading the target fluid out of the outlet-side tank therethrough; and a plurality of tubes each extending from the inlet-side tank to the outlet-side tank, wherein: at least one of the inlet-side tank and the outlet-side tank comprises: a sidewall extending along a given axis and surrounding the axis; and an end wall closing an opening at an end of the sidewall in a longitudinal direction of the tank along the axis; the plurality of tubes are fixed to the sidewall in a state in which they penetrate through the sidewall via respective ones of a plurality of through-holes formed in the sidewall in such a manner as to be arrayed in a line along the longitudinal direction, and the heat exchanger further comprises a protective member fixed to the sidewall to protect a nearest tube nearest to the end wall among the plurality of tubes. The protective member has a barrier portion interposed between the end wall and an end portion of the nearest tube disposed inside the sidewall.

The present invention can suppress occurrence of a crack in the fixed portion of the tube with respect to the tank.

DESCRIPTION OF EMBODIMENTS

With reference to the accompanying drawings, the present invention will now be described based on embodiments thereof. It should be noted that the following embodiments are shown as specific examples of the present invention, but are not intended to limit the technical scope of the present invention.

<First Embodiment (FIGS. 1 to 5)>

Figure 1:
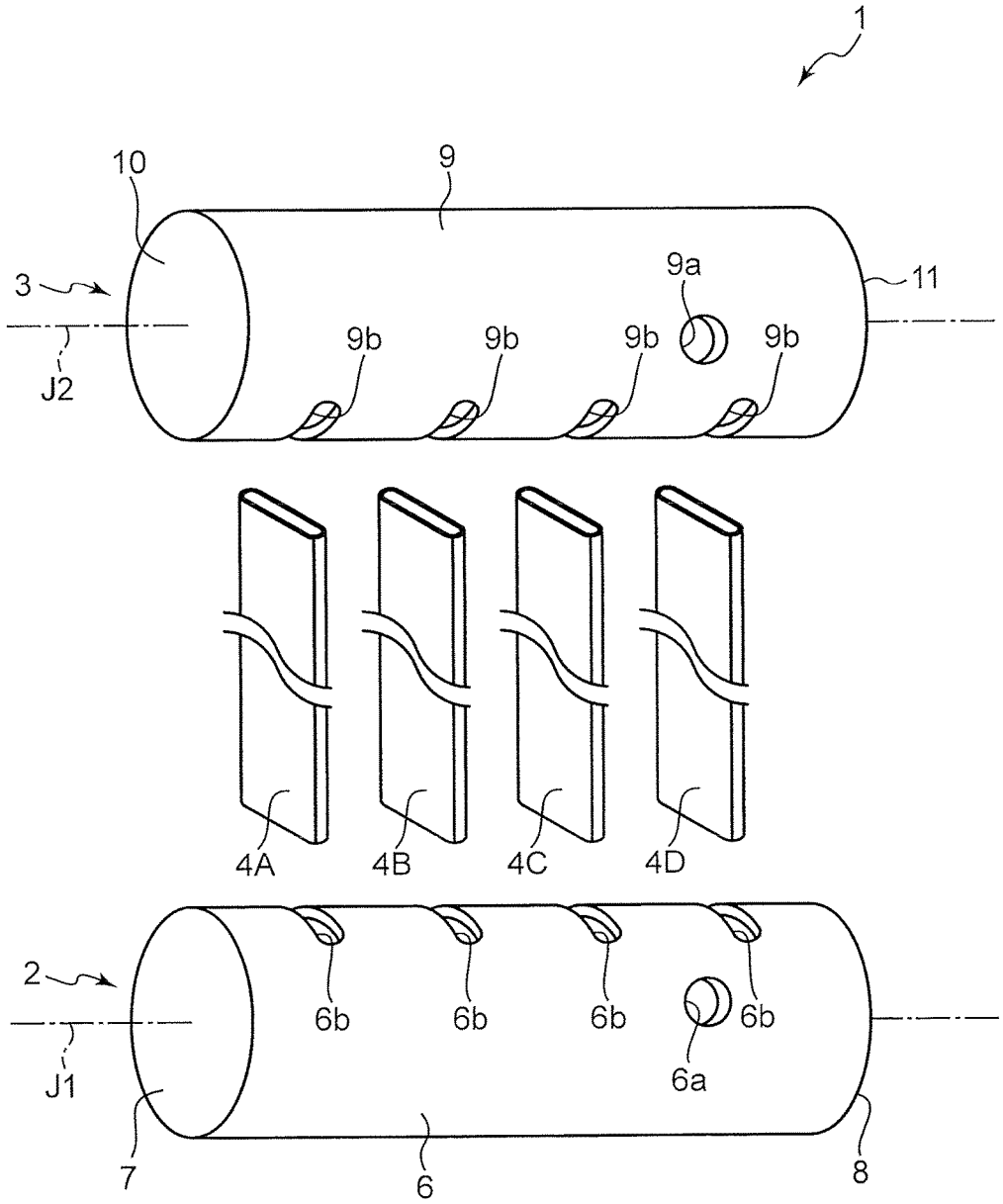
FIG. 1 is an exploded perspective view depicting a heat exchanger according to a first embodiment of the present invention.

Referring to FIG. 1, a heat exchanger 1 according to a first embodiment of the present invention is provided as a means to cool a target fluid such as coolant water of an engine (not depicted) or hydraulic oil.

The heat exchanger 1 comprises: an inlet-side tank 2 having an inlet port 6*a* for leading a target fluid to be cooled, into the inlet-side tank 2 therethrough; an outlet-side tank 3 having an outlet port 9*a* for leading the target fluid out of the outlet-side tank 3 therethrough; and four tubes 4A to 4D each extending from the inlet-side tank 2 to the outlet-side tank 3.

The inlet-side tank 2 comprises a sidewall 6 extending along a given axis J1 and surrounding the axis J1, and two end walls 7, 8 closing, respectively, two openings at opposite ends of the sidewall 6 in a longitudinal direction of the inlet-side tank 2 (a rightward-leftward direction in FIG. 1) along the axis J1.

The sidewall 6 is formed with the inlet port 6*a*, and four through-holes 6*b* arrayed in a line along the longitudinal direction of the inlet-side tank 2 (the rightward-leftward direction in FIG. 1). The inlet port 6*a* and each of the through-holes 6*b* are provided at positions offset from each other about the axis J1 by about 90 degrees.

The outlet-side tank 3 comprises a sidewall 9 extending along a given axis J2 and surrounding the axis J2, and two end walls 10, 11 closing, respectively, two openings at opposite ends of the sidewall 9 in a longitudinal direction of the outlet-side tank 3 (the rightward-leftward direction in FIG. 1) along the axis J2.

The sidewall 9 is formed with the outlet port 9*a*, and four through-holes 9*b* arrayed in a line along the longitudinal direction of the outlet-side tank 3 (the rightward-leftward direction in FIG. 1). The outlet port 9*a* and each of the through-holes 9*b* are provided at positions offset from each other about the axis J2 by about 90 degrees.

Then, the inlet-side tank 2 and the outlet-side tank 3 are arranged such that the axis J1 and the axis J2 extend in parallel relation to each other, and the array of through-holes 6*b* and the array of through-holes 9*b* arc symmetrically opposed to each other.

The tubes 4A to 4D are fixed to the sidewalls 6, 9 in a state in which they penetrate through the sidewalls 6, 9 via respective ones of the four opposed pairs of through-holes 6*b*, 9*b*.

Figure 5:
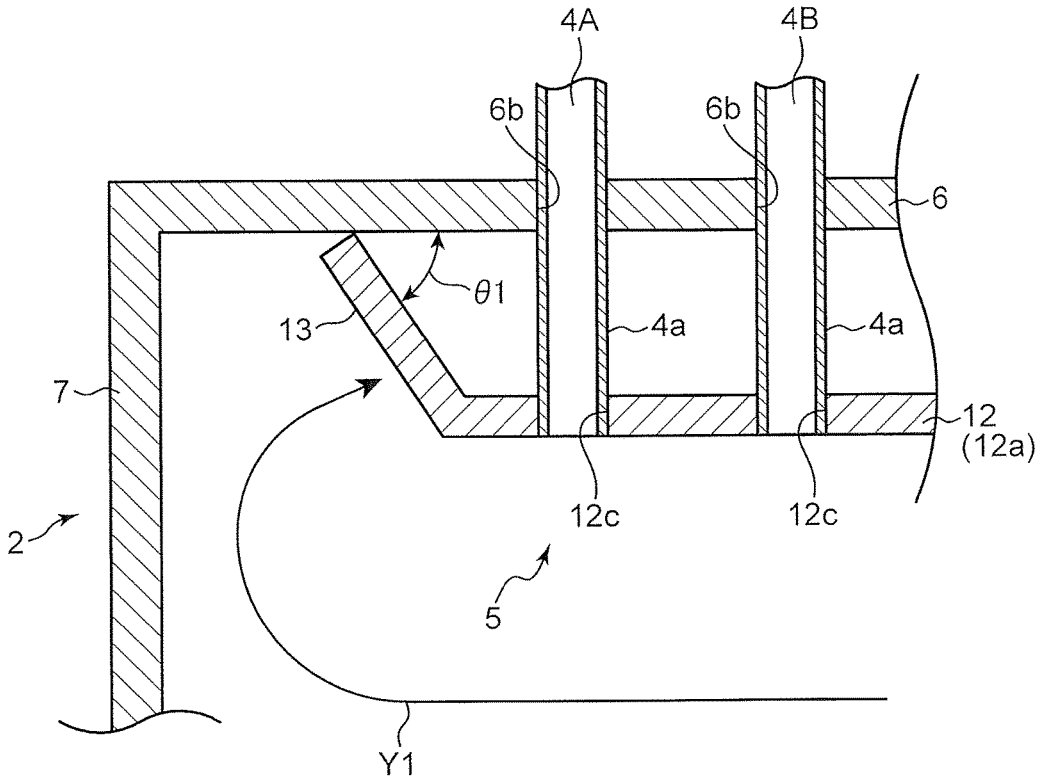
FIG. 5 is a partially-omitted side sectional view depicting an inlet-side tank of the heat exchanger in FIG. 1.

Specifically, as depicted in FIG. 5, an inlet-side end portion portion 4*a* of each of the tubes 4A to 4D (in FIG. 5, only the tubes 4A, 4B are depicted) is disposed inside the sidewall 6 via a corresponding one of the through-holes 6*b*. In this state, a base of the inlet-side end portion 4*a* of each of the tubes 4A to 4D are fixed to the sidewall 6 by brazing or the like.

Figure 4:
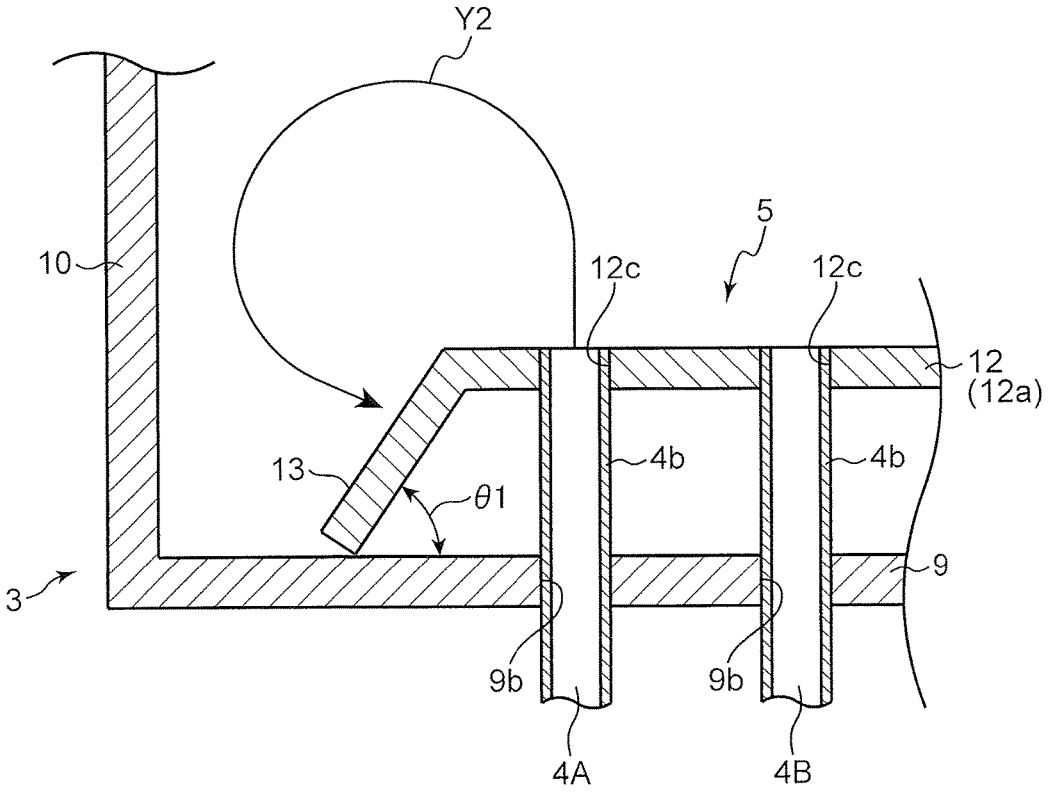
FIG. 4 is a partially-omitted side sectional view depicting the outlet-side tank of the heat exchanger in FIG. 1.

On the other hand, as depicted in FIG. 4, an outlet-side end portion 4*b* of each of the tubes 4A to 4D (in FIG. 4, only the tubes 4A, 4B are depicted) is disposed inside the sidewall 9 via a corresponding one of the through-holes 9*b*. In this state, a base of the outlet-side end portion 4*b* of each of the tubes 4A to 4D are fixed to the sidewall 9 by brazing or the like.

Referring to FIGS. 1, 4 and 5, a crack is likely to occur in a fixed portion of the tube 4A nearest to the end walls 7, 10 among the four tubes (hereinafter referred to occasionally as "the nearest tube 4A") or a fixed portion of the tube 4D nearest to the end walls 8, 11 among the four tubes (hereinafter referred to occasionally as "the nearest tube 4D"), with respect to each of the sidewalls 6, 9. The reason is considered as follows.

In the inlet-side tank 2, the target fluid led through the inlet port 6*a* is moved in the longitudinal direction, and finally led into the tubes 4A to 4D. However, in the course of the above movement, when the target fluid reaches the end wall 7 and becomes unable to go straight ahead any more, it is turned toward the inlet-side end portion 4*a* of the nearest tube 4A nearest to the end wall 7, as indicated by the arrowed line Y1 of FIG. 5. Due to the above flow, the inlet-side end portion 4*a* of the nearest tube 4A is applied with a force from the target fluid and thereby inclined about the base of the inlet-side end portion 4*a* serving as a supporting point, in a direction away from the end wall 7, and, accordingly, a crack is likely to occur in the fixed portion (particularly, a part of the fixed portion on the side of the end wall 7). The fixed portion of the nearest tube 4D nearest to the end wall 8 is also likely to crack due to the flow of the target fluid turned by the end wall 8.

On the other hand, in the outlet-side tank 3, the target fluid led via the tubes 4A to 4D is moved in the longitudinal direction, and finally led into the outlet port 9*a*. However, in the course of the above movement, when the target fluid reaches the end wall 10 and becomes unable to go straight ahead any more, it is turned toward the outlet-side end portion 4*b* of the nearest tube 4A nearest to the end wall 10, as indicated by the arrowed line Y2 of FIG. 4. Due to the above flow, the outlet-side end portion 4*b* of the nearest tube 4A is applied with a force from the target fluid and thereby inclined about the base of the nearest end 4*b* serving as a supporting point, in a direction away from the end wall 10, and, accordingly, a crack is likely to occur in the fixed portion (particularly, a part of the fixed portion on the side of the end wall 10). The fixed portion of the nearest tube 4D nearest to the end wall 11 is also likely to crack due to the flow of the target fluid turned by the end wall 11.

In order to prevent the occurrence of a crack in the fixed portion of each of the nearest tubes 4A, 4D, the heat exchanger 1 comprises four protective members 5 each for protecting a respective one of the inlet-side end portion 4*a* of the nearest tube 4A, the inlet-side end portion 4*a* of the nearest tube 4D, the outlet-side end portion 4*b* of the nearest tube 4A, and the outlet-side end portion 4*b* of the nearest tube 4D (in FIGS. 4 and 5, only two protective members 5 for protecting the nearest tube 4A are depicted).

Each of the four protective members 5 has the same configuration. Thus, the following description will be made mainly about the protective member 5 for protecting the outlet-side end portion 4*b* of the nearest tube 4A, with reference to FIGS. 2 to 4.

The protective member 5 has: a barrier portion 13 interposed between the end wall 10 and the outlet-side end portion 4*b* of the nearest tube 4A; and an extended portion 12 extending from the barrier portion 13 in a direction away from the end wall 10. The protective member 5 is formed by subjecting a single metal plate to bending.

When viewed along the axis J2 (see FIG. 1) (i.e., in FIG. 3), the barrier portion 13 has a size capable of covering only part of a region inside the sidewall 9. Specifically, the barrier portion 13 has a proximal end disposed at a position relatively near to the sidewall 9 and a distal end disposed at a position relatively far from the sidewall 9, and is formed in an approximately rectangular plate shape extending from the proximal end to the distal end.

Further, when viewed along the axis J2, the barrier portion 13 has a size capable of covering an entirety of the outlet-side end portion 4*b* of the nearest tube 4A. Specifically, the barrier portion 13 has a width dimension W2 greater than a width dimension W1 of the nearest tube 4A. The barrier portion 13 is further configured such that a height dimension (reference sign is omitted) from the proximal end to the distal end thereof is approximately equal to a height dimension from the base to a distal edge of the outlet-side end portion 4*b* of the nearest tube 4A. In this embodiment, the proximal end of the barrier portion 13 is not in close contact with the sidewall 9, but, strictly, a small gap is formed between the sidewall 9 and the proximal end of the barrier portion 13. However, this small gap acts as resistance to the target fluid. Thus, despite the presence of the small gap, it is possible to protect the outlet-side end portion 4*b* of the nearest tube 4A from the target fluid. That is, the expressions "interposed between the end wall 10 and the outlet-side end portion 4*b* of the nearest tube 4A" and "covering an entirety of the end portion of the nearest tube" include not only a state in which the barrier portion is in close contact with the sidewall 9, but also a state in which a small gap is formed between the barrier portion 13 and the sidewall 9.

Further, a surface of the barrier portion 13 facing the barrier portion 13 is inclined such that a distance to the end wall 10 gradually increases toward a center of a space surrounded by the sidewall 9. Specifically, the barrier portion 13 is attached to the sidewall 9 in a posture in which it is inclined with respect to the axis J2 (see FIG. 1) by an angle θ1 (in FIG. 4, the angle θ1 is indicated as an angle with respect to the sidewall 9).

The extended portion 12 has: a covering section 12*a* extending from the distal end of the barrier portion 13 toward the side away from the end wall 10 in the longitudinal direction of the outlet-side tank 3 (the rightward-leftward direction in FIG. 1); and a pair of fixing sections 12*b* extending from the covering section 12*a*, respectively, toward opposite sides in a direction orthogonal to the longitudinal direction of the outlet-side tank 3.

The covering section 12*a* covers the base of the outlet-side end portion 4*b* of the nearest tube 4A disposed inside the sidewall 9, from the side opposed to the sidewall 9 (from a central side of the space surrounded by the sidewall 9) and restrains the outlet-side end portion 4*b* of the nearest tube 4A from being inclined in the direction away from the end wall 10.

Specifically, the covering section 12*a* is formed with two fitting holes 12*c* each penetrating through the covering section 12*a* in a direction orthogonal to the axis J2 (see FIG. 1). The nearest tube 4A is inserted and fitted into one of the fitting holes 12*c*, and the tube 4B is inserted and fitted into the other fitting hole 12*c*. In this state, the covering section 12*a* covers an entire circumference of the base of the outlet-side end portion 4*b* of the nearest tube 4A, from the side opposed to the sidewall 9. Further, the protective member 5 (covering section 12*a*) is fixed to the sidewall 9 through the fixing sections 12*b*, so that it is possible to restrain inclination of the outlet-side end portion 4*b* of the nearest tube 4A fitted in the covering section 12*a*, as described in detail later.

Similarly, as depicted in FIG. 5, the nearest tube 4A and the tube 4B are also fitted with respect to the protective member 5 provided in the inlet-side tank 2 so as to protect the inlet-side end portion 4*a* of the nearest tube 4A. Further, although depiction is omitted, the nearest tube 4D and the tube 4C are fitted with respect to the protective member 5 provided in the inlet-side tank 2 so as to protect the inlet-side end portion 4*a* of the nearest tube 4D. Furthermore, the nearest tube 4D and the tube 4C are also fitted with respect to the protective member 5 provided in the outlet-side tank 3 so as to protect the outlet-side end portion 4*b* of the nearest tube 4D.

Figure 2:
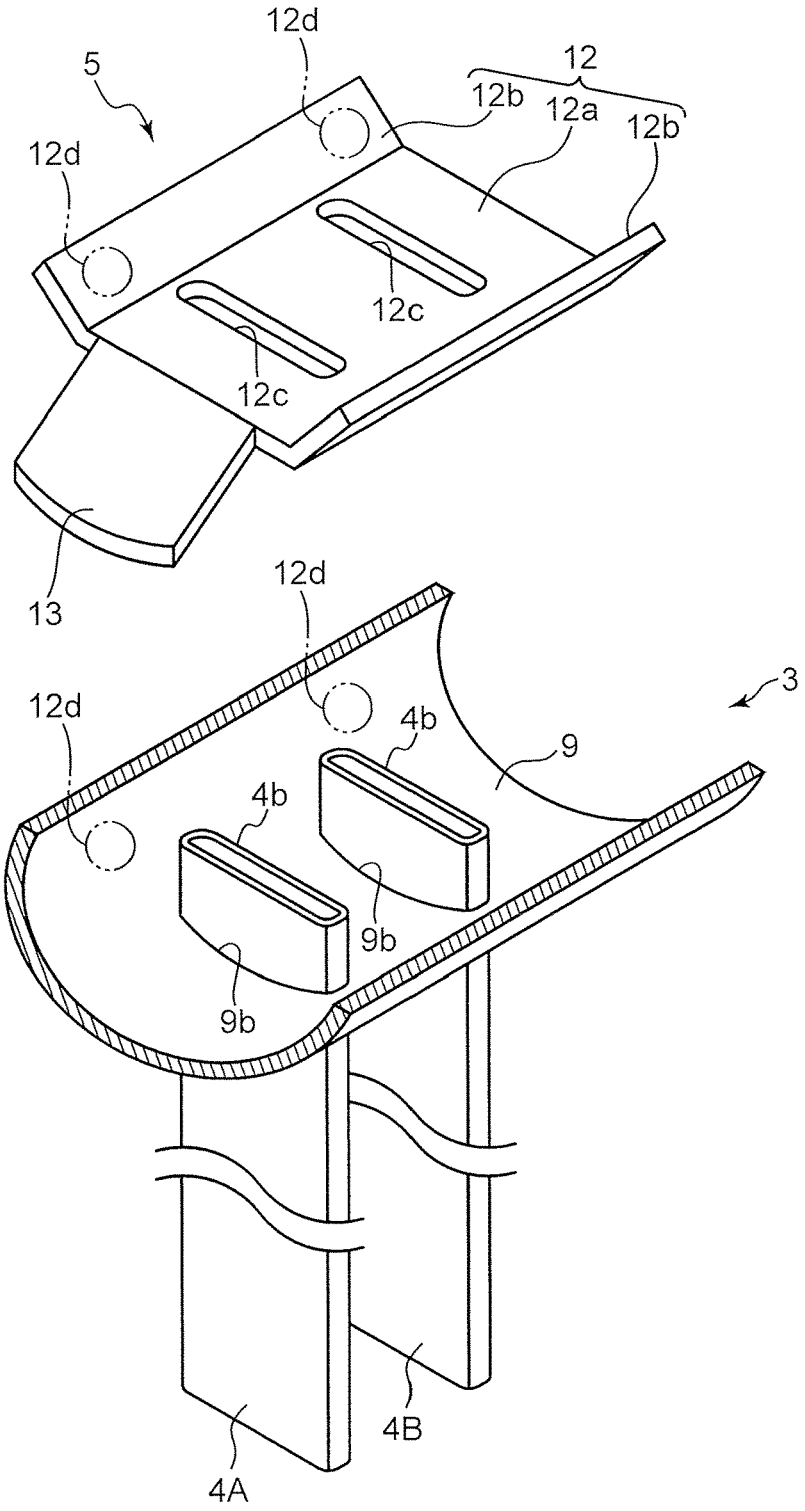
FIG. 2 is a cutaway exploded perspective view depicting a part of the heat exchanger in FIG. 1.
Figure 3:
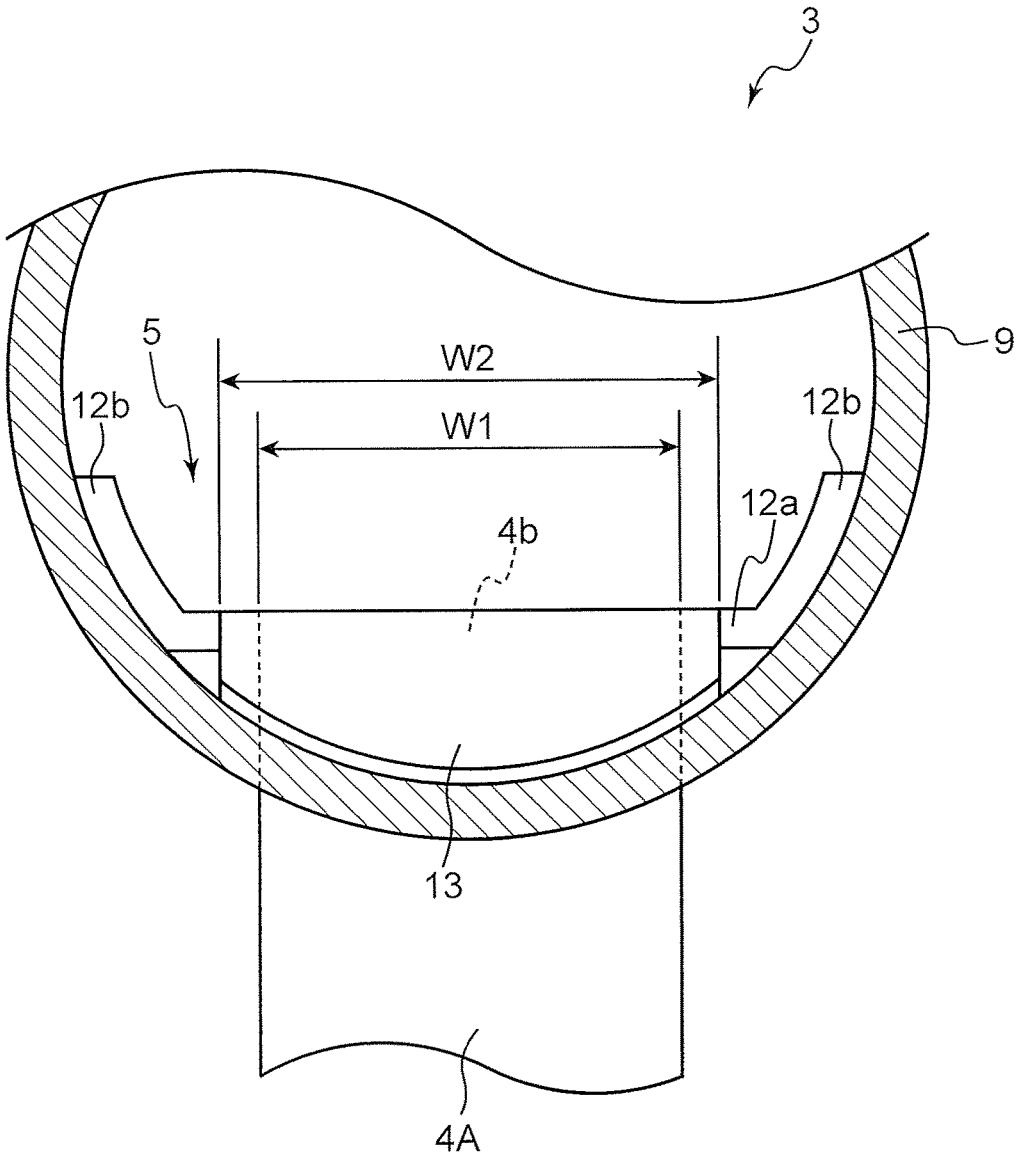
FIG. 3 is a partially-omitted front sectional view depicting an outlet-side tank of the heat exchanger in FIG. 1.

Referring to FIGS. 2 to 4, each of the fixing sections 12*b* is fixed to the sidewall 9 through a plurality of welding areas 12*d*. Specifically, the fixing section 12*b* is a section bended with respect to the covering section 12*a* to extend along an inner surface of the sidewall 9. The fixing section 12*b* is brought in a close contact with the inner surface of the sidewall 9, and then partly welded thereto through the plurality of welding areas 12*d*. Although FIG. 2 depicts only the welding areas 12*d* in one of the fixing sections 12*b*, the other fixing section 12*b* is also fixed to the sidewall 9 through the welding areas 12*d*.

In the heat exchanger 1 configured as above, the barrier portion 13 and the covering section 12*a* can prevent the flow of the target fluid returned by the end wall 7 (or the end wall 8) from being led to the inlet-side end portion 4*a* of the nearest tube 4A (or the nearest tube 4D) in the inlet-side tank 2, as indicated by the arrowed line Y1 in FIG. 5.

Further, the barrier portion 13 and the covering section 12*a* can prevent the flow of the target fluid returned by the end wall 10 (or the end wall 11) from being led to the outlet-side end portion 4*b* of the nearest tube 4A (or the nearest tube 4D) in the outlet-side tank 3, as indicated by the arrowed line Y2 in FIG. 4.

As described above, the barrier portion 13 functions to block the flow of the target fluid directed from the end wall (7, 8, 10, 11) toward the end portion of the nearest tube (4A, 4D), so that it becomes possible to reduce a force to be applied from the target fluid to the nearest tube (4A, 4D).

This makes it possible to suppress occurrence of a crack in a fixed portion of the nearest tube (4A, 4D) with respect to the tank (2, 3).

Further, the first embodiment can bring out the following advantageous effects.

The surface of the barrier portion 13 facing the end wall (7, 8, 10, 11) nearest from the barrier portion 13 is inclined with respect to a flow direction of the target fluid (the longitudinal direction), so as to lead, along the barrier portion 13, the target fluid flowing from the end wall toward the barrier portion 13, to the side opposed to the sidewall (6, 9) (the central side of the space surrounded by the sidewall (6. 9)). Thus, it becomes possible to reduce resistance of the barrier portion 13 with respect to the target fluid.

When viewed along the axis (J1, J2), the barrier portion 13 has a size capable of covering only part of the region inside the sidewall (6, 9). Thus, the target fluid is allowed to flow from one of the opposite end walls to the other end wall, via a space between the barrier portion 13 and the sidewall (6, 9), so that it becomes possible to inhibit the target fluid from being turned toward the nearest tube (4A, 4D) by the barrier portion 13.

When viewed along the axis (J1, J2), the barrier portion 13 can cover the entirety of the end portion (4*a*, 4*b*) of the nearest tube (4A, 4D) disposed inside the sidewall (6, 9), so that it becomes possible to reliably reduce a force to be applied from the target fluid flowing from the end wall (7, 8, 10, 11) toward the nearest tube (4A, 4D), to the nearest tube (4A, 4D).

The barrier portion 13 and the covering section 12*a* can form a housing which houses a part of the base of the nearest tube (4A, 4D) on the side of a nearest one of the end walls 7, 8, 10, 11, so that it becomes possible to suppress intrusion of the target fluid from the side of the end wall and the side opposed to the sidewall (6, 9) (the central side of the space surrounded by the sidewall (6. 9)), to the base of the nearest tube (4A, 4D). This makes it possible to more reliably protect the nearest tube (4A, 4D).

The barrier portion 13 restrains inclination of the nearest tube (4A, 4D), so that it becomes possible to more reliably prevent the occurrence of a crack in the fixed portion of the nearest tube (4A, 4D) with respect to the tank (2, 3).

The covering section 12*a* covering the end portion of the nearest tube (4A, 4D) from the side opposed to the sidewall (6, 9) can be additionally used as a section for supporting the end portion of the nearest tube (4A, 4D).

The end portion (4*a*, 4*b*) of the nearest tube (4A, 4D) can be supported by a simple structure composed of the fitting hole 12*c*.

<Second Embodiment (FIG. 6)>

In the first embodiment, the surface of the barrier portion 13 facing the end wall (7, 8, 10, 11) is inclined such that the distance to the end wall (7, 8, 10, 11) gradually increases toward the center of the space surrounded by the sidewall (6, 9) (the barrier portion 13 is inclined by θ1). However, the angle of the surface of the barrier portion 13 facing the end wall (7, 8, 10, 11) is not particularly limited.

Figure 6:
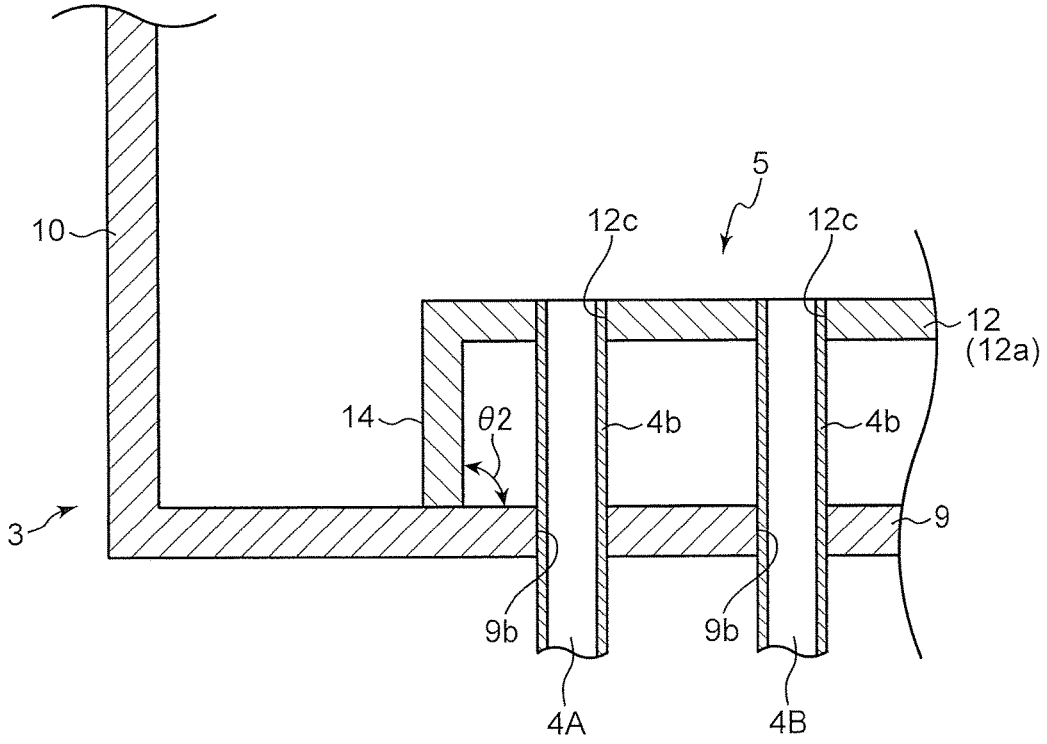
FIG. 6 is a partially-omitted side sectional view depicting an outlet-side tank of a heat exchanger according to a second embodiment of the present invention.

For example, as depicted in FIG. 6, in a heat exchanger according to a second embodiment of the present invention, a surface of a barrier portion 14 facing an end wall 10 is disposed to extend in a direction orthogonal to an axis J2 (see FIG. 1). Specifically, the harrier portion 14 is attached to a sidewall 9 in a state in which it is inclined with respect to the axis J2 (see FIG. 1) by an angle θ2 (90 degrees) (FIG. 6 depicts a state in which it is inclined with respect to the sidewall 9 by an angle θ2).

Alternatively, the surface of the barrier portion facing the end wall (7, 8, 10, 11) may be inclined such that the distance to the end wall (7, 8, 10, 11) gradually decreases toward the center of the space surrounded by the sidewall (6, 9), although depiction is omitted.

However, in the case where the surface of the barrier portion 14 facing the end wall 10 is disposed to extend in the direction orthogonal to the axis J2 (see FIG. 1), the surface of the barrier portion 14 extends perpendicularly with respect to the flow of the target fluid directed from the end wall 10 toward the nearest tube 4A. This causes an increase in resistance to the target fluid. Further, in the case where the surface of the barrier portion facing the end wall (7, 8, 10, 11) is inclined such that the distance to the end wall (7, 8, 10, 11) gradually decreases toward the center of the space surrounded by the sidewall (6, 9), the target fluid flowing from the end wall (7, 8, 10, 11) toward the nearest tube (4A, 4D) is lead into a narrow gap between the barrier portion (13, 14) and the sidewall (6, 7). This also causes an increase in resistance to the target fluid.

As above, in view of resistance to the target fluid, it is desirable to employ the first embodiment.

<Third Embodiment (FIG. 7)>

In the above embodiments, the protective member 5 has the extended portion 12, in addition to the barrier portion 13. However, the extended portion 12 may be omitted.

Figure 7:
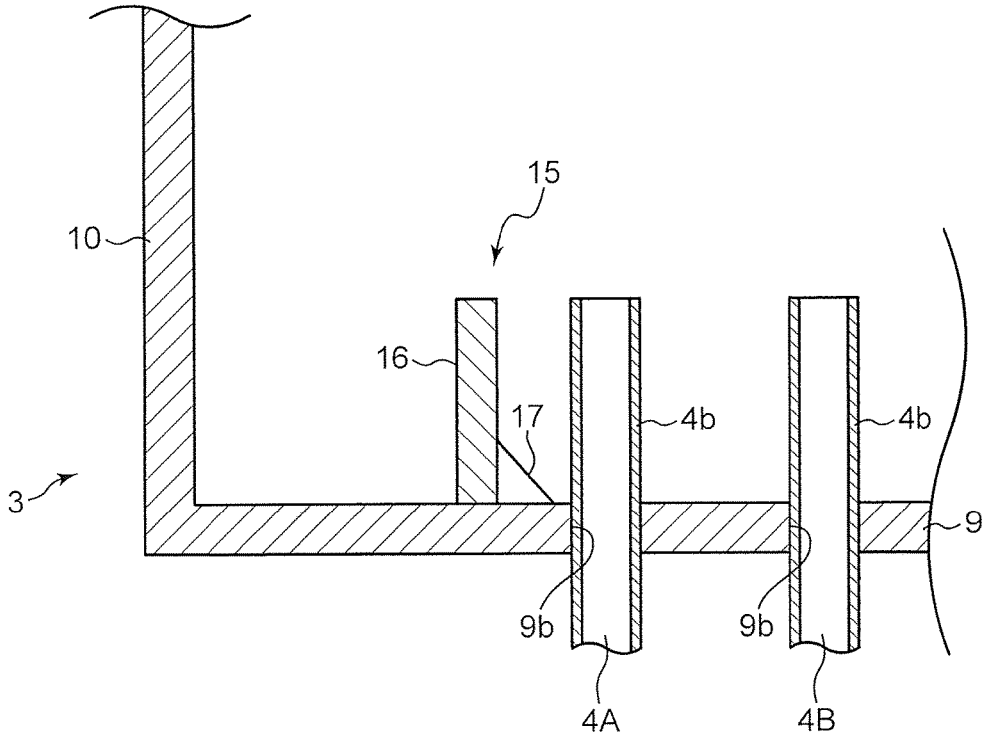
FIG. 7 is a partially-omitted side sectional view depicting an outlet-side tank of a heat exchanger according to a third embodiment of the present invention.

Specifically, as depicted in FIG. 7, a protective member 15 in a heat exchanger according to a third embodiment of the present invention comprises a barrier portion 16 fixed to a sidewall 9.

In this protective member 15, the barrier portion 16 can block the target fluid flowing from an end wall toward a nearest tube 4A, so that it becomes possible to suppress occurrence of a crack in a fixed portion of the nearest tube 4A with respect to the sidewall 9.

Although the barrier portion 16 is disposed in a state orthogonal to an axis J2 (see FIG. 1), it may be disposed with an inclination with respect to the axis J2, in the same manner as that in the above embodiments.

In order to prevent the barrier portion 16 from collapsing (falling down) toward the nearest tube 4A due to a force applied from the target fluid, the protective member 15 further comprises a support portion 17 for preventing collapse of the barrier portion 16. The support portion 17 is fixed to the barrier portion 16 and the sidewall 9 at a position between the barrier portion 16 and the nearest tube 4A.

Although the third embodiment has been described based on an example in which the extended portion 12 is entirely omitted, the extended portion 12 may be partly omitted. For example, an extended portion (covering section) may be provided which extends from a distal end of the barrier portion 16 depicted in FIG. 7 in a direction away from the end wall 10 so as to connect between the barrier portion 16 and the nearest tube 4A. By providing such an extended portion, it is possible to cover a part of an outlet-side base 4*b* of the nearest tube 4A on the side of the end wall 10, from the side opposed to the sidewall 9 (a central side of a space surrounded by the sidewall 9).

<Fourth Embodiment (FIG. 8)>

The above embodiments employ the inlet-side tank 2 configured such that the openings at the opposite ends of the sidewall 6 in the longitudinal direction along the axis 31 are closed, respectively, by the end walls 7, 8, and the outlet-side tank 3 configured such that the openings at the opposite ends of the sidewall 9 in the longitudinal direction along the axis J2 are closed, respectively, by the end walls 10, 11.

However, each of the inlet-side tank and the outlet-side tank may be configured such that an opening at only one of the opposite ends of the sidewall in the longitudinal direction along the axis is closed by an end wall.

Figure 8:
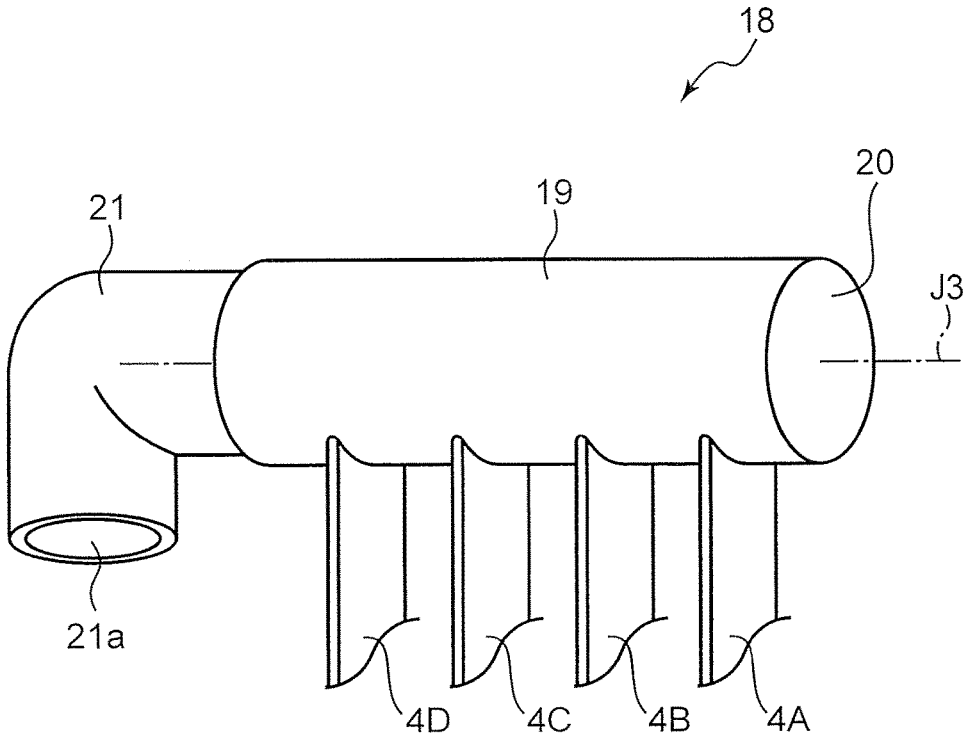
FIG. 8 is a perspective view depicting a schematic configuration of an inlet-side tank of a heat exchanger according to a fourth embodiment of the present invention.
Figure 9:
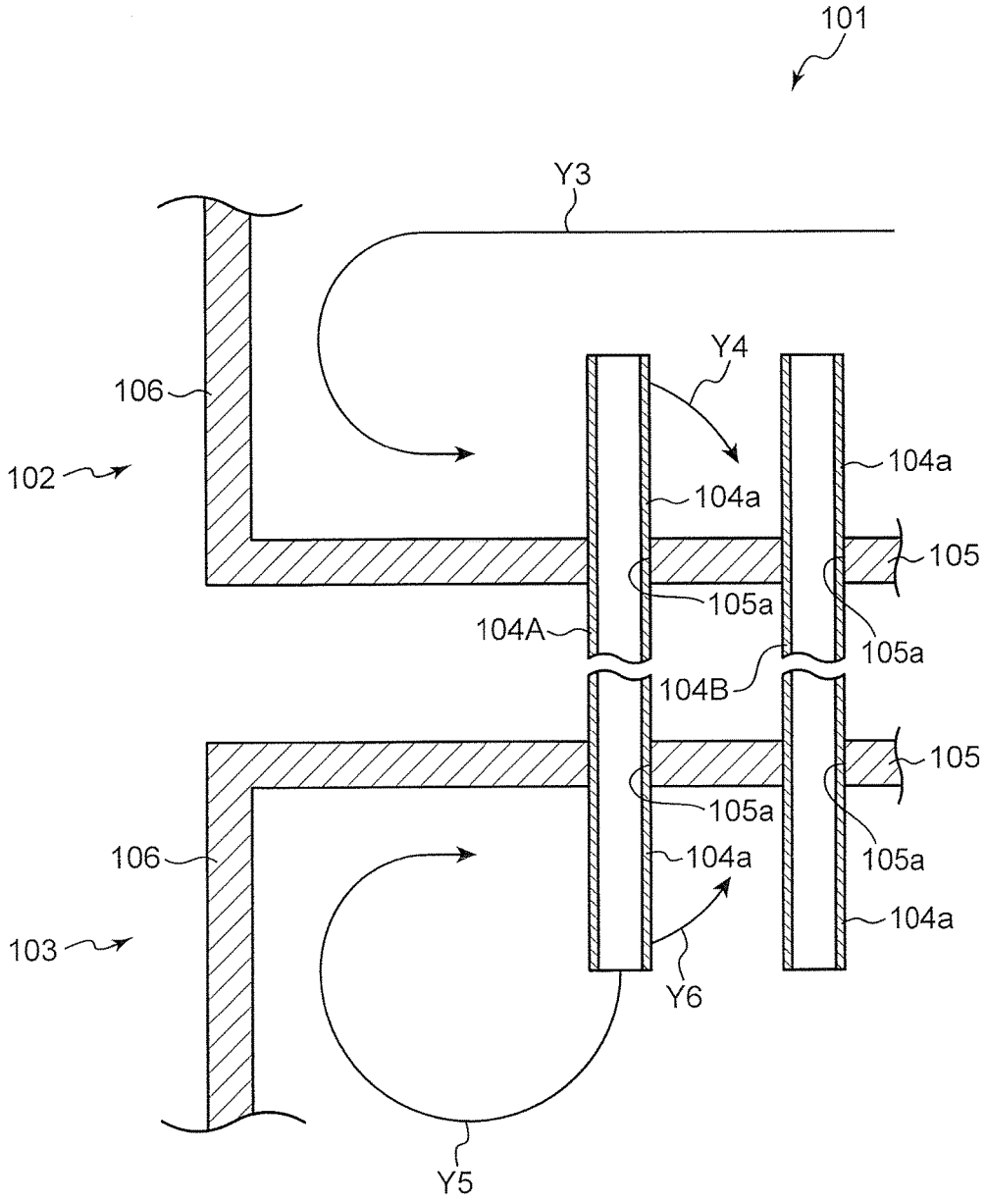
FIG. 9 is a partially-omitted side sectional view depicting a conventional heat exchanger.

Specifically, as depicted in FIG. 8, a heat exchanger according to a fourth embodiment of the present invention comprises an inlet-side tank 18. The inlet-side tank 18 has a sidewall 19 extending along a given axis J3 and surrounding the axis J3; an end wall 20 closing an opening at one of opposite ends of the sidewall 19 in a longitudinal direction of the inlet-side tank 18 along the axis J3 (a rightward-leftward direction in FIG. 8); and an inlet pipe 21 connected to the other end of the sidewall 19 in the longitudinal directon.

The sidewall 19 is formed with four through-holes (reference sign is omitted) arrayed in a line along the longitudinal direction of the inlet-side tank 18. Four tubes 4A to 4D are fixed to the sidewall 19 in a state in which they penetrate through the sidewall 19 via respective ones of the through-holes.

The inlet pipe 21 has an extended portion extending from the other end of the sidewall 19 along the axis J3, and a bent portion extending from an upstream end of the extended portion in a direction orthogonal to the extended portion. An upstream end of the bent portion of the inlet pipe 21 is formed as an inlet port 21*a* for leading the target fluid into the inlet pipe 21 therethrough.

As above, the inlet-side tank 18 in the fourth embodiment has only one end wall 20.

This inlet-side tank 18 is also provided with the aforementioned protective member for protecting the nearest tube 4A nearest to the end wall 20. Although depiction is omitted, the protective member comprises the aforementioned barrier portion (13, 14, 16) interposed between the end wall 20 and an inlet-side end portion of the nearest tube 4A disposed inside the sidewall 19.

In the fourth embodiment, the barrier portion of the protective member can prevent the target fluid returned by the end wall 20 from being led to the inlet-side end portion of the nearest tube 4A. This makes it possible to suppress occurrence of a crack in a fixed portion of the nearest tube 4A with respect to the inlet-side tank 18.

Although the fourth embodiment has exemplified the inlet-side tank 18 having only one end wall 20, the present invention may be applied to a heat exchanger comprises an outlet-side tank having only one end wall.

It is to be understood that the present invention is not limited to the above embodiment. For example, the following configurations may be employed.

Although the above embodiments have been described based on an example in which, when viewed along the axis (J1, J2), the barrier portion (13, 14, 16) has a size capable of covering the entirety of the end portion (4*a*, 4*b*) of the nearest tube (4A, 4D), the barrier portion (13, 14, 16) may have a size capable of covering only part of the nearest tube (4A, 4D), when viewed along the axis (J1, J2).

Although the above embodiments have been described based on an example in which the heat exchanger comprises four protective members 5, the number of the protective members 5 is not limited to four, but the heat exchanger may be provided with at least one protective member 5. Specifically, in the above embodiments, the protective member 5 is provided in each of the two tanks 2, 3. Alternatively, the protective member 5 may be provided in only one of the two tanks 2, 3. Further, in the above embodiments, the inlet-side tank 2 is provided with two protective members for protecting both of the two nearest tubes 4A, 4D nearest, respectively, to the end walls 7, 8. Alternatively, the inlet-side tank 2 may be provided with only one protective member for protecting one of the nearest tubes 4A, 4D. Similarly, the outlet-side tank 3 may be provided with only one protective member for protecting one of the two nearest tubes 4A, 4D nearest, respectively, to the end walls 10, 11.

Although the above embodiments have been described based on an example in which the heat exchanger comprises four tubes 4A to 4D, the number of the tubes is not limited to four, but the heat exchanger may be provided with any plural number of the tubes.

Although the above embodiments have been described based on an example in which the protective member 5 is formed with two fitting holes 12*c* for allowing the tubes 4A, 4B, or the tubes 4C, 4D to be fitted thereinto, the number of the fitting holes is not limited to two. In the case of forming the fitting hole, the protective member 5 may be provided with at least one fitting hole for allowing the nearest tube to be fitted therein.

The aforementioned specific embodiments primarily include an invention having the following features.

In order to solve the aforementioned problem, the present invention provides a heat exchanger for cooling a target fluid. The heat exchanger comprises: an inlet-side tank having an inlet port for leading the target fluid into the inlet-side tank therethrough; an outlet-side tank having an outlet port for leading the target fluid out of the outlet-side tank therethrough; and a plurality of tubes each extending from the inlet-side tank to the outlet-side tank, wherein: at least one of the inlet-side tank and the outlet-side tank comprises: a sidewall extending along a given axis and surrounding the axis; and an end wall closing an opening at an end of the sidewall in a longitudinal direction of the tank along the axis; the plurality of tubes are fixed to the sidewall in a state in which they penetrate through the sidewall via respective ones of a plurality of through-holes formed in the sidewall in such a manner as to be arrayed in a line along the longitudinal direction, and the heat exchanger further comprises a protective member fixed to the sidewall to protect a nearest tube nearest to the end wall among the plurality of tubes. The protective member has a barrier portion interposed between the end wall and an end portion of the nearest tube disposed inside the sidewall.

In the heat exchanger of the present invention, the barrier portion functions to block the flow of the target fluid directed from the end wall toward the end portion of the nearest tube, so that it becomes possible to reduce a force to be applied from the target fluid to the nearest tube.

This makes it possible to suppress occurrence of a crack in a fixed portion of the nearest tube with respect to the tank.

In the above heat exchanger, a surface of the barrier portion facing the end wall may be formed to extend in a direction orthogonal to the longitudinal direction of the tank, or in a direction along which a distance to the end wall gradually decreases toward a center of a space surrounded by the sidewall. However, in the case where the surface of the barrier portion facing the end wall is disposed to extend in the direction orthogonal to the longitudinal direction of the tank, the surface of the barrier portion extends perpendicularly with respect to a flow direction of the target fluid (the longitudinal direction of the tank). This causes an increase in resistance of the barrier portion to the target fluid. Further, in the case where the surface of the barrier portion facing the end wall is inclined such that the distance to the end wall gradually decreases toward the center of the space surrounded by the sidewall, the target fluid flowing from the end wall toward the barrier portion is lead into a narrow gap between the sidewall and the surface of the barrier portion facing the end wall. This also causes an increase in resistance of the barrier portion to the target fluid.

Therefore, in the above heat exchanger, the surface of the barrier portion facing the end wall is preferably inclined such that the distance to the end wall gradually increases toward the center of the space surrounded by the sidewall.

According to this aspect, the surface of the barrier portion facing the end wall is inclined with respect to the flow direction of the target fluid (the longitudinal direction), so as to lead, along the barrier portion, the target fluid flowing from the end wall toward the barrier portion, to the side opposed to the sidewall (the central side of the space surrounded by the sidewall). Thus, it becomes possible to reduce resistance of the barrier portion with respect to the target fluid.

In the above heat exchanger, if the barrier portion has a size capable of covering an entirety of a region inside the sidewall, when viewed along the axis, the target fluid flowing from the side opposite to the end wall in the longitudinal direction of the tank becomes unable to go straight any more, so that the target fluid is likely to be turned toward the nearest tube, thereby exerting a negative influence on the nearest tube Therefore, in the above heat exchanger, the barrier portion preferably has a size capable of covering only part of a region inside the sidewall, when viewed along the axis, According to this aspect, the target fluid is allowed to flow from the side opposite to the end wall toward the end wall in the longitudinal direction of the tank, via a space between the barrier portion and the sidewall, so that it becomes possible to inhibit the turned target fluid from being turned toward the nearest tube by the barrier portion.

In the above heat exchanger, when viewed along the axis, the barrier portion may have a size capable of covering only part of the end portion of the nearest tube disposed inside the sidewall. Even in this case, the barrier portion can block a part of the target fluid flowing from the end wall toward the nearest tube, to thereby suppress occurrence of a crack in a fixed portion of the nearest tube with respect to the sidewall.

Particularly, in the above heat exchanger, the barrier portion preferably has a size capable of covering an entirety of the end portion of the nearest tube disposed inside the sidewall, when viewed along the axis.

According to this aspect, the end portion of the nearest tube disposed inside the sidewall can be entirely covered by the barrier portion, when viewed along the axis, so that it becomes possible to reliably reduce a force to be applied from the target fluid flowing from the end wall toward the nearest tube, to the nearest tube.

In the above heat exchanger, the protective member may have only the barrier portion interposed between the end wall and the end of the nearest tube disposed inside the sidewall. In the case, however, the target fluid is likely to intrude from a side opposed to the sidewall (the central side of the space surrounded by the sidewall) to a part of a base of the end portion the nearest tube on the side of the end wall, and impose a load on the end portion of the nearest tube.

Therefore, in the above heat exchanger, the protective member preferably has a covering section which covers at least a part of the base of the end portion of the nearest tube on the side of the end wall, from the side opposed to the sidewall.

According to this aspect, the barrier portion and the covering section can form a housing which houses a part of the base of the nearest tube on the side of the end wall, so that it becomes possible to suppress intrusion of the target fluid from the side of the end wall and the side opposed to the sidewall (the central side of the space surrounded by the sidewall), to the base of the nearest tube. This makes it possible to more reliably protect the nearest tube.

In the above heat exchanger, the covering section may have only a function of covering the end portion of the nearest tube from the side opposed to the sidewall.

In the above heat exchanger, the covering section preferably supports the end portion of the nearest tube disposed inside the sidewall in such a maimer as to restrain the end portion of the nearest tube from being inclined in a direction away from the end wall.

According to this aspect, the covering section restrains inclination of the nearest tube, so that it becomes possible to more reliably prevent the occurrence of a crack in the fixed portion of the nearest tube with respect to the tank.

Further, the covering section covering the end portion of the nearest tube from the side opposed to the sidewall can be additionally used as a section for supporting the end portion of the nearest tube.

Although it is not intended to limit the shape of the covering section, in the above heat exchanger, the covering portion is formed with a fitting hole which penetrates through the covering section in a direction orthogonal to the axis and in which the end portion of the nearest tube is fitted.

According to this aspect, the end portion of the nearest tube can be supported by a simple structure composed of the fitting hole.

The invention claimed is:

1. A heat exchanger for cooling a target fluid, comprising:

an inlet-side tank having an inlet port for leading the target fluid into the inlet-side tank therethrough;

an outlet-side tank having an outlet port for leading the target fluid out of the outlet-side tank therethrough; and a plurality of tubes each extending from the inlet-side tank to the outlet-side tank, wherein:

at least one of the inlet-side tank and the outlet-side tank comprises:

a sidewall extending along a given axis and surrounding the axis, and an end wall closing an opening at an end of the sidewall in a longitudinal direction of the tank along the axis;

the plurality of tubes are fixed to the sidewall in a state in which they penetrate through the sidewall via respective ones of a plurality of through-holes formed in the sidewall in such a manner as to be arrayed in a line along the longitudinal direction, the heat exchanger further comprises a protective member fixed to the sidewall to protect a nearest tube nearest to the end wall among the plurality of tubes, the protective member having a barrier portion interposed between the end wall and an end portion of the nearest tube disposed inside the sidewall, the protective member has an extended portion extending from the barrier portion in a direction away from the end wall in the longitudinal direction;

a pair of fixing sections are provided on the extended portion, one of the pair of fixing sections being disposed at one side portion of the extended portion in a direction orthogonal to the longitudinal direction of the extended portion and the other of the pair of fixing sections being disposed at the other side portion of the extended portion, the pair of fixing sections extending along the longitudinal direction; and a small gap is formed between the sidewall and the proximal end of the barrier portion, and a space is formed between the barrier portion and the end portion of the nearest tube disposed inside the sidewall, the space allowing the target fluid to intrude thereinto.

2. The heat exchanger as recited in claim 1, wherein a surface of the barrier portion facing the end wall is inclined such that a distance to the end wall gradually increases toward a center of a space surrounded by the sidewall.

3. The heat exchanger as recited in claim 1, wherein, when viewed along the axis, the barrier portion has a size capable of covering only part of a region inside the sidewall.

4. The heat exchanger as recited in claim 1, wherein, when viewed along the axis, the barrier portion has a size capable of covering an entirety of the end portion of the nearest tube disposed inside the sidewall.

5. The heat exchanger as recited in claim 1, wherein the end portion of the nearest tube disposed inside the sidewall has a base, and wherein the protective member has a covering section which covers at least a part of the base on the side of the end wall, from a side opposed to the sidewall.

6. The heat exchanger as recited in claim 5, wherein the covering section supports the end portion of the nearest tube disposed inside the sidewall in such a manner as to restrain the end portion of the nearest tube from being inclined in a direction away from the end wall.

7. The heat exchanger as recited in claim 6, wherein the covering portion is formed with a fitting hole which penetrates through the covering section in a direction orthogonal to the axis and in which the end portion of the nearest tube is fitted.

* * * * *